US005831386A

United States Patent [19]

Turner et al.

[11] Patent Number: 5,831,386

[45] Date of Patent: Nov. 3, 1998

[54] ELECTRODELESS LAMP WITH IMPROVED EFFICACY

[75] Inventors: Brian Turner, Myersville; Mohammad Kamarehi, N. Potomac; Leslie Levine; Michael G. Ury, both of Bethesda, all of Md.

[73] Assignee: Fusion Lighting, Inc., Rockville, Md.

[21] Appl. No.: 324,475

[22] Filed: Oct. 17, 1994

Related U.S. Application Data

[63] Continuation-in-part of Ser. No. 136,078, Oct. 15, 1993, abandoned.

[51] Int. Cl.[6] ..... H01J 17/20

[52] U.S. Cl. ..... 313/570; 313/161; 313/638; 313/573; 315/248; 315/344

[58] Field of Search ..... 313/570, 161, 313/156, 484, 637, 573, 643, 358, 638; 315/248, 344, 39

[56] References Cited

U.S. PATENT DOCUMENTS

| | | | |
|---|---|---|---|
| 3,234,421 | 2/1966 | Reiling | 313/571 X |
| 3,748,520 | 7/1973 | Silver . | |
| 3,764,843 | 10/1973 | Van Eijl et al. | 315/344 |
| 3,873,884 | 3/1975 | Gabriel | 315/344 X |
| 3,984,727 | 10/1976 | Young . | |
| 4,476,413 | 10/1984 | Gough et al. . | |
| 4,501,993 | 2/1985 | Mueller et al. | 313/636 X |
| 4,691,141 | 9/1987 | Buhrer et al. | 313/642 X |
| 4,749,915 | 6/1988 | Lynch et al. | 313/493 X |
| 4,918,352 | 4/1990 | Hess et al. | 313/637 X |
| 4,945,290 | 7/1990 | Eliasson et al. . | |
| 5,069,546 | 12/1991 | Liang et al. . | |

(List continued on next page.)

FOREIGN PATENT DOCUMENTS

| | | |
|---|---|---|
| 52-31583 | 3/1977 | Japan . |
| A-55-10755 | 1/1980 | Japan . |
| 55-95265 | 7/1998 | Japan . |
| 1282239 | 7/1987 | U.S.S.R. . |
| WO92/08240 | 5/1992 | WIPO . |
| WO93/21655 | 10/1993 | WIPO . |
| WO94/08439 | 4/1994 | WIPO . |
| WO95/28069 | 10/1995 | WIPO . |

OTHER PUBLICATIONS

"Radiative Efficiencies of Radio Frequency Sulfur Discharges", by K.J.N. Badura and J.T. Verdeyen, *IEEE Journal of Quantum Electronics,* vol. QE–21, No. 7, Jul. 1985, pp. 748–750.

"Stable Pure Sulfur Discharges and Associated Spectra", by D.A. Peterson and L.A. Schlie, *J. Chem. Phys.*73(4), 15 Aug. 1980, pp. 1551–1566.

"Technique For Measuring Rotational Temperature of Microwave Excited Diatomic Sulfur", by V.E. Merchant and M.L. Andrews, *Applied Optics,* 15 Sep. 1980, vol. 19, No. 18 pp. 3113–3117.

"Detection of Sulfur Dimers in $SF_6$ and $SF_6/O_2$ Plasma–Etching Discharges", by K.E. Greenberg and P.J. Hargis, Jr., *Appl. Phys. Lett. 54(14),* 3 Apr. 1989, pp. 1374–1376.

Bentley et al., "Preparation of Electrodeless Discharge Lamps For Elements Forming Gaseous Covalent Hydrides", Analytical Chemistry, vol. 49, No. 4, Apr. 1977, pp. 551–554, Columbus US.

(List continued on next page.)

*Primary Examiner*—Ashok Patel
*Attorney, Agent, or Firm*—Pollock, Vande Sande & Priddy

[57] ABSTRACT

A sulfur, selenium, and/or tellurium based lamp for providing visible light. The lamp is operated in a regime for providing high efficacy wherein the ratio of the volume to surface area of the bulb is greater than 0.45 cm, the concentration of the sulfur, selenium, or tellurium is less than 1.75 mg/cc, and the power density is between about 100 watts/cc and 5 watts/cc.

11 Claims, 3 Drawing Sheets

U.S. PATENT DOCUMENTS

| | | | |
|---|---|---|---|
| 5,212,424 | 5/1993 | Russell et al. | 313/642 X |
| 5,404,076 | 4/1995 | Dolan et al. | 313/572 |
| 5,448,135 | 9/1995 | Simpson | 315/248 X |
| 5,493,184 | 2/1996 | Wood et al. | 315/344 |

OTHER PUBLICATIONS

James T. Dolan, Michael G. Ury and Charles H. Wood, "A Novel High Efficacy Microwave Powered Light Source", Presented as a Landmark Paper, Sep. 2, 1992, Sixth International Symposium on the Science and Technology of Light Sources, Technical University of Budapest.

Abstract of "A Novel High Efficacy Microwave Powered Light Source", from Invited Papers and Abstracts, The 6th International Symposium On The Science & Technology of Light Sources, Budapest—Hungary, 30 Aug.–3 Sep. 1992.

D.A. MacLenna, J.T. Dolan, B.P. Turner, "Small Long–Lived Stable Light Source for Projection–Display Applications", Society for Information Display, International Symposium, Digest of Technical Papers, vol. XXIV, pp. 716–719, May 19, 1993.

ELECTRODELESS LAMP WITH IMPROVED EFFICACY

CROSS REFERENCES TO RELATED APPLICATIONS

This application is a continuation-in-part of U.S. application Ser. No. 08/136,078, filed Oct. 15, 1993, now abandoned.

BACKGROUND OF THE INVENTION

1. Field of the Invention

The present invention is directed to an improved method for generating radiation, and to an improved lamp.

2. Description of the Prior Art

Electrodeless lamps which are used for illumination applications, and which are powered by electromagnetic energy, including microwave and R.F., are known. It is also known that such lamps may include a fill where the emission is generated with sulfur or selenium, or a compound thereof. Such a lamp is disclosed in U.S. application Ser. No. 071,027, filed Jun. 3, 1993, now U.S. Pat. No. 5,404,076, and PCT International Publication No. WO 92/08240, which are incorporated herein by reference.

As is well known, an important figure of merit of lamp performance is efficacy, i.e., the visible light output as compared to the electrical power inputted to the lamp, as this determines the cost of operating the lamp. The lamp disclosed in the above-mentioned PCT Publication is of a type having a high efficacy. In accordance with the present invention, it has been found that the efficacy of such a lamp can be improved still further to a substantial extent by operating the lamp in a specific regime.

SUMMARY OF THE INVENTION

In accordance with a first aspect of the present invention, a lamp wherein sulfur, selenium, or tellurium is the primary light emitting substance is operated in a regime wherein the ratio of volume to surface area of the lamp envelope is at least 0.45 cm.

Providing a large volume to surface area ratio minimizes the heat which is lost through the wall of the lamp envelope. Since the electrical power inputted is converted to either light or heat, increasing the volume to surface area ratio has the effect of increasing the efficiency of light emission. In the case of a spherical envelope, the volume to surface area ratio is increased by increasing the diameter of the envelope.

In accordance with a second aspect of the present invention, a lamp wherein sulfur, selenium, or tellurium is the primary light emitting substance is operated in a regime wherein the ratio of volume to surface area of the lamp envelope is at least 0.45 cm, the concentration of the sulfur, selenium, or tellurium during operation is less than 1.75 mg/cc, and the power density is less than about 100 watts/cc and greater than about 5 watts/cc. Operation in this regime produces the unexpected result of a substantial improvement in efficacy.

BRIEF DESCRIPTION OF THE DRAWINGS

The invention will be better appreciated in accordance with the accompanying figures, wherein.

DESCRIPTION OF PREFERRED EMBODIMENTS

Figure 1:
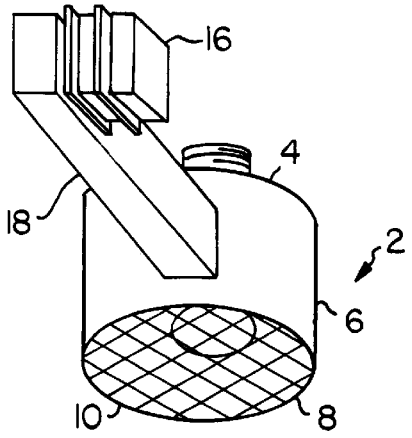
FIG. 1 is a perspective view of an embodiment of the invention.

Referring to FIG. 1, lamp 2 is depicted which is an embodiment of the invention which is powered by microwave energy, it being understood that R.F. energy may be used as well.

Lamp 2 includes a microwave cavity 4 which is comprised of metallic cylindrical member 6 and metallic mesh 8. Mesh 8 is effective to allow the light to escape from the cavity while retaining the microwave energy inside.

Figure 2:
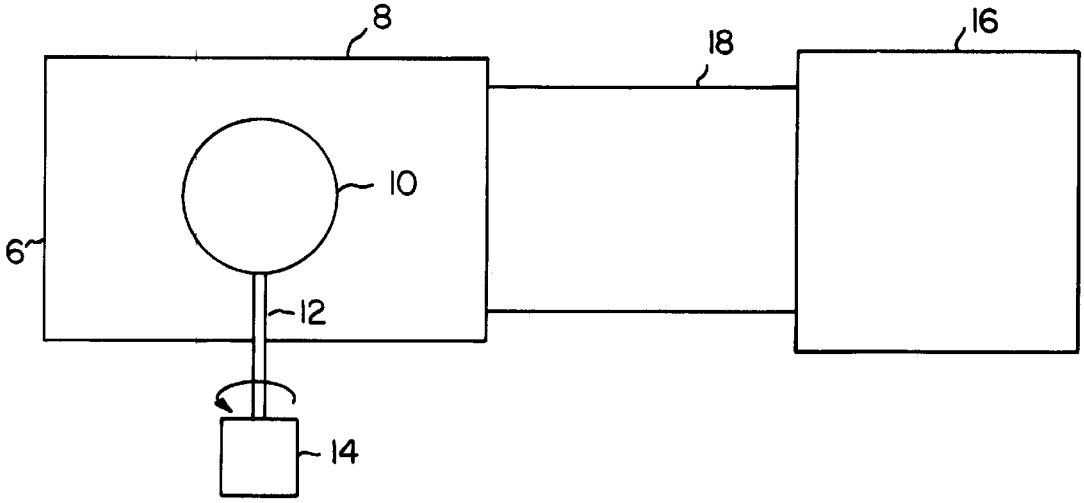
FIG. 2 is a side view of the embodiment of FIG. 1.

Bulb 10 is disposed in the cavity, which in the embodiment depicted is spherical. Referring to FIG. 2, the bulb is supported by stem 12, which is connected with motor 14 for effecting rotation of the bulb. This rotation promotes stable operation of the lamp.

Microwave energy is generated by magnetron 16, and waveguide 18 transmits such energy to a slot (not shown) in the cavity wall, from where it is coupled to the cavity and particularly to the fill in bulb 10.

Bulb 10 consists of a bulb envelope and a fill in the envelope. The fill includes sulfur, selenium, or tellurium, or a compound of one of these substances. Examples of substances which may be used in the fill are InS, $As_2S_3$, $S_2Cl_2$, $CS_2$, $In_2S_3$, SeS, $SeO_2$, $SeCl_4$, SeTe, $SCe_2$, $P_2Se_5$, $Se_3As_2$, TeO, TeS, $TeCl_5$, $TeBr_5$, and $TeI_5$.

Additionally, other sulfur, selenium, and tellurium compounds may be used, for example those which have a relatively low vapor pressure at room temperature, i.e., they are in solid or liquid state, and a vapor pressure at operating temperature which is sufficient to maintain useful light output.

In accordance with an aspect of the invention, the ratio of the volume to surface area of the lamp envelope is at least 0.45 cm. As discussed above, this promotes high efficacy. The preferred ratio of volume to surface area is above 0.6 cm. As used herein, the "surface area" in the term "volume to surface area" refers to the outside surface area of the bulb envelope (the volume being internal to the inside surface area).

Additionally, the concentration of the sulfur, selenium, or tellurium during operation is below 1.75 mg/cc and the power density is below about 100 watts/cc and above about 5 watts/cc.

It is notable that the lamp of the invention achieves operation at power densities which are below 20 watt/cc.

The term "power density" refers to the power inputted to the bulb divided by the bulb volume. One may employ in the lamps of the invention any fill including one or a combination of fill materials which, at lamp operating temperature and at the selected power density, yields sufficient concentration of sulfur, selenium, and/or tellurium in the envelope to provide useful illumination.

The lamp may output a reduced amount of spectral energy in the infrared, and spectral shifts with variations in power density have been observed. Forced air cooling may be required at higher power densities.

EXAMPLE I

Figure 3:
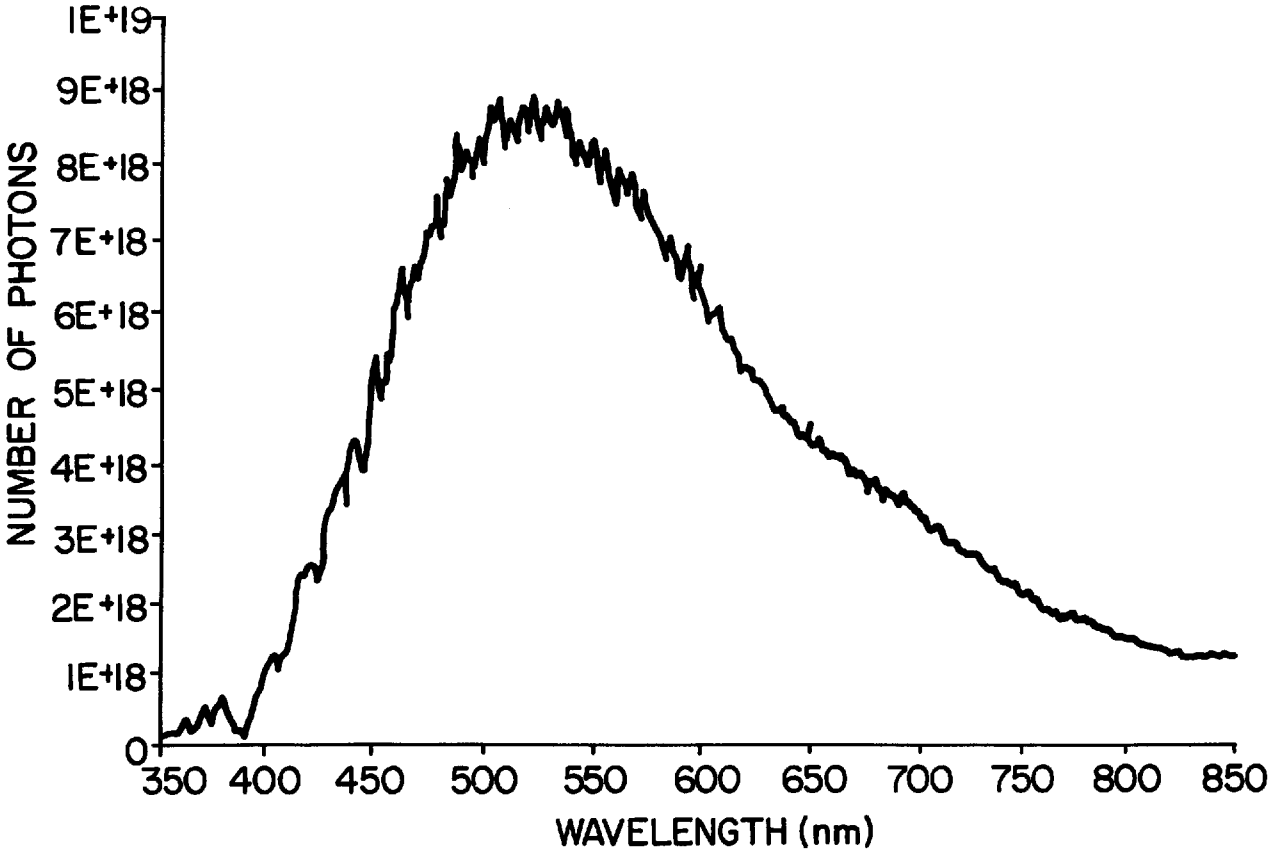
FIG. 3 is a spectrum of emitted light using a sulfur fill.

In a specific embodiment of the invention which was tested, a spherical bulb of outside diameter 4.7 cm (wall thickness of 1.5 mm) was used, resulting in a volume to surface area ratio of 0.64 cm. The applied power was 1100 watts, the fill was sulfur at a concentration of 1.3 mg/cc, resulting in a power density of 19.5 watts/cc, and the bulb was rotated at 300 RPM. Visible light was produced having a spectrum as shown in FIG. 3. The average efficacy around the bulb was 165 lumens/watt (microwave watt). The ratio of the visible spectral power produced to the infrared spectral power was 10 to 1. As is typical in lamps of this general type, the fill included an inert gas, specifically 150 torr of argon.

Comparison (Example I)

In the example in the above-mentioned PCT Publication having a "sulfur only" fill, an electrodeless quartz bulb of spherical shape having an internal diameter of 2.84 cm, (O.D. 30 mm), and a volume to surface area ratio of 0.43 cm, was filled with 0.062 mg-moles/cc (1.98 mg/cc) of sulfur, and 60 torr of argon. When excited with microwave energy at a power density of about 280 watts/cc, the efficacy around the lamp was 140 lumens/watt.

EXAMPLE II

Figure 4:
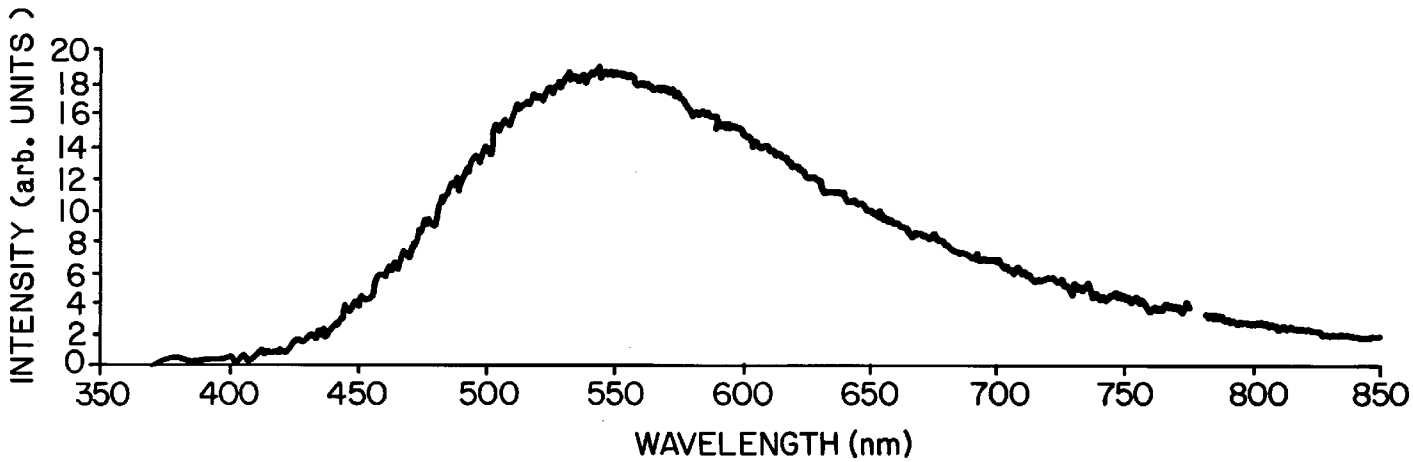
FIG. 4 is a spectrum of emitted light using a selenium fill.

A spherical bulb of diameter 40 mm OD (37 mm ID), resulting in a volume to surface area ratio of 0.53 cm was filled with 34 mg of Se, and 300 torr of xenon gas, resulting in a selenium concentration of 1.28 mg/cc. The lamp was powered by 1000 microwave watts inside a resonant cavity. Visible light was produced having a spectrum as shown in FIG. 4. The average efficacy around the bulb exceeded 180 lumens/watt.

Comparison (Example II)

As disclosed in the above-mentioned PCT Publication, an electrodeless quartz bulb having a volume of 12 cc (wall thickness of 1.5 mm) was filled with 54 mg of selenium and with 60 torr of argon. The bulb was placed in a microwave cavity and excited with 3500 watts of microwave energy. The average efficacy around the bulb was about 120 lumens/watt.

As can be seen by referring to the above examples, a substantial improvement in efficacy is achieved by operating in the regime which is taught herein.

EXAMPLE III

Figure 5:
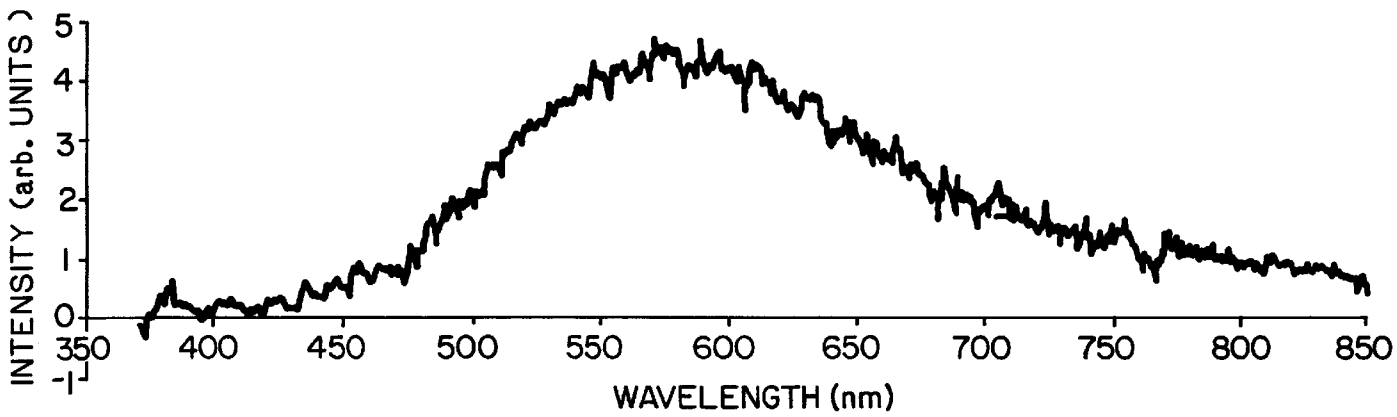
FIG. 5 is a spectrum of emitted light using a tellurium fill.

A spherical bulb of 40 mm OD (37 mm ID) resulting in a volume to surface area ratio of 0.53 cm was filled with 20 mg of tellurium and 100 torr of xenon, resulting in a tellurium concentration of 0.75 mg/cc. The lamp was powered with about 1100 watts inside a microwave cavity. Visible light was produced having a spectrum as shown in FIG. 5. The average efficacy around the bulb was at least 105 lumens/watt.

A lamp having improved efficacy has been disclosed. While the invention has been disclosed in connection with preferred and illustrative embodiments, it should be understood that variations of this invention which fall within its spirit and scope may occur to those skilled in the art, and the invention is to be limited only by the claims appended hereto and equivalents.

We claim:

1. A lamp for providing visible light, comprising, a lamp envelope of light transmissive material having a ratio of volume to outer surface area of at least 0.45 cm, which includes a fill containing during excitation at least one member selected from the group consisting of sulfur, selenium and tellurium, wherein said member is present at a concentration of less than 1.75 mg/cc, sufficient to cause said member to emit primarily visible light in the form of molecular radiation at the operating temperature of the lamp, and means for coupling electromagnetic energy to the fill at a power density between about 5 watts/cc and about 100 watts/cc, sufficient to cause emission of said visible light from said envelope.

2. The lamp of claim 1 wherein said member selected is sulfur.

3. The lamp of claim 2 wherein said ratio is volume to surface area of at least 0.6 cm.

4. The lamp of claim 1 wherein said member selected is selenium.

5. The lamp of claim 4 wherein said a ratio is volume to surface area of at least 0.6 cm.

6. The lamp of claim 1 wherein said member selected is tellurium.

7. The lamp of claim 6 wherein said a ratio is volume to surface area of at least 0.6 cm.

8. The lamp of claim 1 wherein said lamp provides mostly visible light, which is emitted primarily by said selected member or members.

9. The lamp of claim 8 wherein said electromagnetic energy is microwave energy.

10. The lamp of claim 1 wherein said electromagnetic energy is microwave energy.

11. The lamp of claim 1 wherein said lamp envelope has a volume to surface area ratio of at least 0.6 cm.

* * * * *

UNITED STATES PATENT AND TRADEMARK OFFICE

CERTIFICATE OF CORRECTION

PATENT NO : 5,831,386

DATED : November 3, 1998

INVENTOR(S): TURNER, Brian P., et al.

It is certified that error appears in the above-identified patent and that said Letters Patent is hereby corrected as shown below:

Column 4, in the claims:

line 34, between "said" and "ratio" delete --a--.

line 38, between "said" and "ratio" delete --a--.

line 47, replace "claim 1" with --claim 8--.

Signed and Sealed this

Eighth Day of June, 1999

*Attest:*

Q. TODD DICKINSON

*Attesting Officer*

*Acting Commissioner of Patents and Trademarks*